United States Patent [19]

Narita et al.

[11] Patent Number: 4,810,120

[45] Date of Patent: Mar. 7, 1989

[54] PERFECTING PRINTER WITH TURNOVER UNIT

[75] Inventors: Harufumi Narita; Reiji Kanemori, both of Osaka, Japan

[73] Assignee: Nippon I.C.S. Kabushiki Kaisha, Osaka, Japan

[21] Appl. No.: 143,048

[22] Filed: Jan. 12, 1988

[30] Foreign Application Priority Data

Jan. 16, 1987 [JP] Japan ..... 62-8425

[51] Int. Cl.[4] ..... B41J 13/00; B41J 3/54; B65H 29/58

[52] U.S. Cl. ..... 400/624; 400/188; 400/578; 271/291; 271/301; 101/296

[58] Field of Search ..... 400/188, 189, 190, 578, 400/624, 625, 120, 636; 101/230, 229, 231, 262, 296; 271/301, 291, 65

[56] References Cited

U.S. PATENT DOCUMENTS 4,714,241 12/1987 Randall ..... 271/301 X

FOREIGN PATENT DOCUMENTS 42674 4/1981 Japan ..... 400/629
31178 2/1984 Japan ..... 400/624
59-11587 7/1984 Japan ..... 400/188
158275 9/1984 Japan ..... 400/624
212368 10/1985 Japan ..... 400/578
60-257254 12/1985 Japan ..... 400/188
148080 7/1986 Japan ..... 400/636
211067 9/1986 Japan ..... 400/624

OTHER PUBLICATIONS

Cochran, et al., "Document Flipping with Reversing Nip Rolls", IBM Tech. Disc. Bul., vol. 23, No. 6, Nov. 1980, pp. 2214–2216.

Jenkins, "Sheet Flip Enhancer", *IBM Tech. Disc. Bul.*, vol. 23, No. 7A, Dec. 1980, pp. 2635–2636.

*Primary Examiner*—Clifford D. Crowder

*Attorney, Agent, or Firm*—Birch, Stewart, Kolasch, & Birch

[57] ABSTRACT

A perfecting printer comprises a feeding roller for successively feeding cutforms accommodated in a feed stacker onto a transfer path provided with pairs of reversible transfer rollers. Each cutform is first transferred forward past a printing unit without printing. The cutform is then transferred rearward and printed on its front face. The one-face printed cutform is then guided into a return path which joins the transfer path at a position before the printing unit. Upon passage through the return path, the cutform is turned over and returned to the stacker by a turnover unit disposed above the stacker. Finally, the turned over cutform is transferred forward and printed on its rear face again by the same printing unit.

19 Claims, 7 Drawing Sheets

PERFECTING PRINTER WITH TURNOVER UNIT

BACKGROUND OF THE INVENTION

1. Field of the Invention

This invention relates to a perfecting printer for separately printing both faces of individual cutforms by a single printing unit.

2. Description of the Prior Art

Perfect or two-face printing is advantageous in that it halves the total number of sheets or cutforms required to print out a given amount of information by one-face printing. Because of such an advantage, various attempts have been made to provide perfecting printers.

In one possible example, a perfecting printer employs two separate printing units respectively for printing the front and rear faces of each cutform during a single forward transfer thereof.

Another example of perfecting printer incorporates a single printing unit through which each cutform is passed twice, first with its front face directed to the printer head and next with its rear face directed thereto. A more specific arrangement of such an example is disclosed in Japanese Patent Application Laid-open No. 59-115875 (Laid-open: July 4, 1984; Filed: Dec. 23, 1982; Application No.: 57-224852; Inventor: Yutaka OGINOTANI) or in Japanese Patent Application Laid-open No. 60-257254 (Laid-open: Dec. 19, 1985: Filed: June 4, 1984: Application No.: 59-114045; Inventor: Osamu SAKAI et al) and for clarity will now be described with reference to FIG. 9 of the accompanying drawings.

Referring to FIG. 9, a prior art perfecting printer comprises a feed stacker 100 receiving a stack of cutforms or sheets 101, and a feeding roller 102 disposed above the stacker 100 for successively feeding the cutforms 101 onto a transfer path 103. A printing unit 104 is arranged at an intermediate position of the transfer path 103. Behind the printing unit 104 is a pivotal shift plate 105 for selectively directing the cutform 101 into a return-turnover path 106 or into a discharge stacker 107. The return-turnover path 106 extends substantially around the printing unit 104 and is provided with pairs of return rollers 108. Adjacent to the outlet end of the return-turnover path 106 is a re-feeding device 109 which is selectively pivotable to a first position for continuity with the return-turnover path 106 or to a second position for continuity with a guide plate 110 located immediately before the feeding roller 102.

In operation, each cutform 101 fed onto the transfer path 103 with its top edge t directed forward is advanced by a pair of transfer rollers 111. During such advance, the front face of the cutform 101 is printed from the top edge t by the printing unit 104, as illustrated in FIG. 10*a*. At this time, the shift plate 105 is pivoted to its lower position indicated in solid lines in FIG. 9. Thus, the cutform 101 is directed into the return-turnover path 106 after front-face printing.

Since the return path 106 extends substantially around the printing unit 104, the cutform 101 is completely turned over after it has been moved through the path 106 by the return rollers 108. The cutform 101 thus turned over is received in the re-feeding device 109 pivoted to the first position. The re-feeding device 109 is then pivoted to the second position indicated in broken lines in FIG. 9 to re-feed the cutform 101 onto the transfer path 103 by way of the guide plate 110.

The cutform 101 now with its bottom edge b directed forward is advanced along the transfer path 103. During this second forward transfer, the rear face of the cutform is printed from its bottom edge b, as shown in FIG. 10*b*.

Finally, the shift plate 105 is pivotally raised, and the cutform 101 is taken out into the discharge stacker 107.

Though capable of printing both faces of each cutform 101 by the single printing unit 104, the prior art printer has the following disadvantages.

According to the prior art arrangement, since the cutform 101 is transferred only in the forward direction on the transfer path 103, the inlet end of the return-turnover path 106 must be positioned behind the printing unit 104 in order to receive the cutform 101 after printing. Therefore, the return path 106 must extends substantially around or over the printing unit 104 to bring the cutform 101 back to the feed side of the printing unit 104. Such an arrangement inevitably results in a considerable increase in the overall size of the printer, thereby providing difficulty in manufacture and handling.

Further, with the prior art printer, printing on the front face of the cutform 101 is started from the top edge t, whereas printing on the rear face thereof is initiated from the bottom edge b. Such a printing manner requires complicated control of the printing unit 104 in order to provide identical margins (side margins as well as top and bottom margins) with respect to both faces of the rectangular cutform 101. Particularly, when the cutform 101 carries ruled frames 112, 112' (see FIGS. 10*a* and 10*b*) or lines (not shown) at corresponding positions on both faces thereof, variations or deviations in printing positions due to poor control of the printing unit 104 become unacceptable. In addition, a similar problem also occurs due to an unexpected slide in the movement of the cutform 101 during printing.

SUMMARY OF THE INVENTION

It is, therefore, an object of the present invention to provide a perfecting printer which, while employing a single printing unit for cost reduction, is extremely compact and simple in construction, and which is substantially free of printing deviations with respect to both faces of each cutform.

Another object of the invention is to provide a perfecting printer which incorporates a novel turnover unit.

According to the invention, there is provided a perfecting printer comprising accommodating means for receiving a stack of cutforms, a transfer path extending from the accommodating means, feeding means for successively feeding the cutforms onto the transfer path, transfer means for reversibly transferring each cutform along the transfer path; printing means for separately printing both faces of the cutform, a return path joining the transfer path at a position before the printing means for allowing return movement therethrough of the cutform when the transfer means is reversed, and turnover means disposed above the accommodating means and adjacent to an outlet of the return path for turning over the cutform received from the return path and for returning it again into the accommodating means.

Other objects, features and advantages of the invention will be readily understood from the following detailed description given with reference to the accompanying drawings. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be described, by way of example only but not in a limitative sense, with reference to the accompanying drawings, in which.

DETAILED DESCRIPTION

Figure 1:
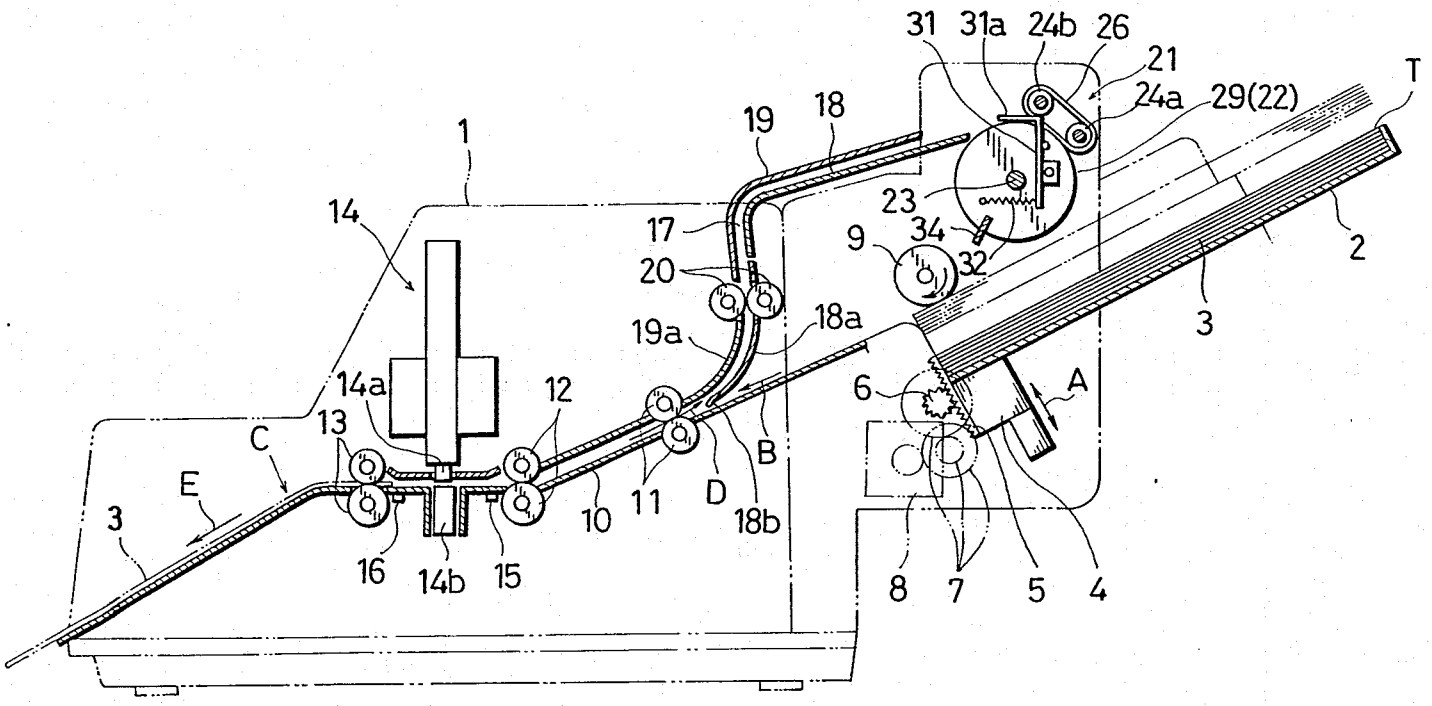
FIG. 1 is an overall side view, in section, of a perfecting printer embodying the invention.
Figure 2:
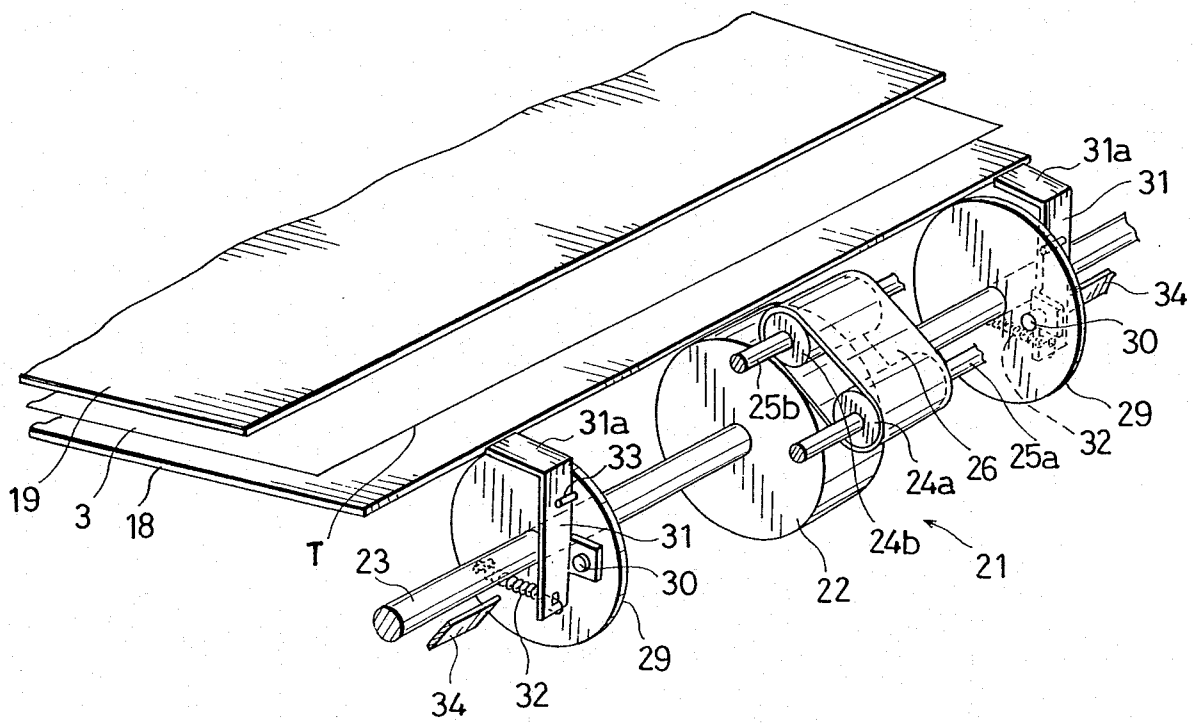
FIG. 2 is a perspective view showing a turnover unit of the printer on a somewhat enlarged scale.

Referring now to FIG. 1 of the accompanying drawings, a perfecting or duplex printer according to the invention includes a printer housing 1 to the rear of which is mounted a feed stacker 2 accommodating a stack of separate sheets or cutforms 3. The feed stacker 2 is accessible from outside to receive another supply of cutforms when needed.

According to the illustrated example, the feed stacker 2 is supported at its front end by a movable carrier 4. A rack 5 fixed to the carrier 4 is in mesh with a pinion 6 which is connected through a train of gears 7 to a pulse motor (stepping motor) 8. Thus, when the motor 7 is selectively rotated in a forward or reverse direction, the stacker 3 is translationally moved up or down, as indicated by a double-headed arrow A.

A feed roller 9 made of rubber for example is disposed immediately above the feed stacker 2 to feed one sheet 3 at a time onto a transfer path. According to the illustrated example, the transfer path is provided by a guide member 10 which may consist of plural guide plates or of a single plate.

Three opposed pairs of transfer rollers 11, 12, 13 are arranged along the transfer path 10, so that each cutform 3 passes between each pair of rollers during transfer. These rollers are drivingly rotatable in both forward and reverse directions for the purpose to be described hereinafter.

Between the two front pairs of transfer rollers 12, 13 in the transfer path 10 is arranged a printing unit 14 which comprises a printer head 14*a*, such as a dot printer head, and a platen 14*b* positioned immediately below the head 14*a* in opposed relation thereto.

Immediately before and beyond the printing unit 14 are respectively arranged a pair of sensors 15, 16 which detect the forward and rearward edges of each cutform 3 to generate operational signals for the printer head 14*a*.

According to the invention, a return path 17 meets the transfer path 10 at a position immediately before the rearmost pair of transfer rollers 11. More specifically, the return path 17 is defined by slightly spaced inner and outer return guide members 18, 19 each of which may be constituted by plural plates or by a single plate. Each return guide member has a lower portion 18*a*, 19*a* which is gently curved to provide a smooth continuity of the return path 17 with the transfer path 10 when viewed in the return direction.

Preferably, the lower edge 18*b* of the inner guide member 18 is slightly bent downward to widen the inlet end of the return path 10. The purpose of this arrangement will be explained hereinafter.

The return path 17 is provided at an intermediate position thereof with a pair of return rollers 20 which are drivingly rotated only in one direction, i.e., in the return direction. If required, an additional pair or pairs of return rollers may be provided.

The return path 17 extends to a location above the feed stacker 3 where a turnover unit 21 is arranged.

Figure 3:
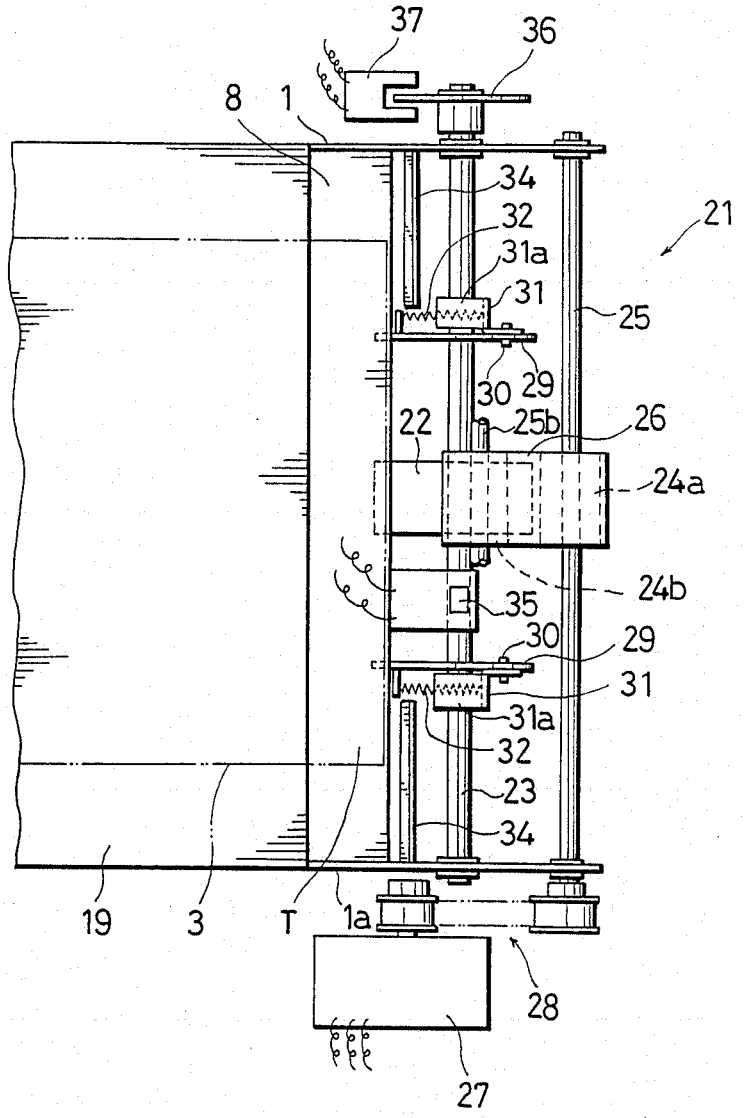
FIG. 3 is a top plan view of the turnover unit.

As illustrated in FIGS. 2 to 5, the turnover unit 21 includes a turnover roller 22 supported on a main shaft 23 which in turn is rotatably supported by a pair of side walls 1*a* of the housing 1 (see FIG. 3). A drive roller 4*a* and a free roller 24*b* are mounted respectively on a drive shaft 25*a* and a free shaft 25*b*, both shafts being also rotatably supported by the housing side walls 1*a*. An endless belt 26 is wound round the drive and free rollers 24*a*, 24*b*, and held in driving contact with the turnover roller 22.

One end of the drive shaft 25*a* is connected to a pulse motor (stepping motor) 27 by means of a transmission 28, as illustrated in FIG. 3. Thus, when the motor 27 is operated, the turnover roller 22 is rotated to pull in the cutform 3 exiting from the return path 17.

The turnover unit 21 further includes a pair of trap disks 29 mounted on the main shaft 23 on both sides of the turnover roller 22. Each disk 29 is substantially equal in diameter to the trap roller 22 and carries a pin 30 by which is pivotally supported a trap lever 31 formed at one end with a pawl 31*a*. The other end of the lever 31 is connected to one end of a weak spring 32 having its other end fixed to a suitable portion of the disk 29. The spring 32 causes the lever 31 to pivotally come into abutment with a stopper pin 33 which is fixed at another suitable portion of the disk 29. In this position, the pawl 31*a* of the lever 31 is located outside the circumference of the disk 29. However, when the lever 31 is pivoted against the spring 32, the pawl 31 can come inside the disk circumference.

A pair of sheet stoppers 34 extend laterally inward from the housing side walls 1*a* toward the circumference of the respective disks 29. However, the inner ends of the respective stoppers 34 do not interfere with the corresponding trap levers 31 which rotate with the disks. The distance between the respective inner ends of the stoppers 34 is smaller than the width of the sheet 3 (see FIG. 3), so that the forward edge of the sheet can come into abutment with the stoppers 34.

Entry of the sheet 3 into the turnover unit 21 is detected by a sensor 35 disposed over the axis of the turnover roller 22 to start the pulse motor 27.

One end of the main shaft 23 is provided with a positioning disk 36 having a marking slit (not shown). Arranged in cooperative relation to the positioning disk 36 is a photoelectric sensor 37 having a light emitting element (not shown) and a light receiving element (not shown). Normally, the light path of the photoelectric sensor 37 (between the light emitting element and the light receiving element) is interrupted by the positioning disk 36. However, when the marking slit of the disk 36 happens to come in alignment with the light path, the sensor 37 is activated to generate a signal. The position of the marking slit is determined so that such signal generation occurs when each trap disk 22 or the trap lever 31 rotating therewith assumes the initial position illustrated in FIGS. 1 to 4.

The perfecting printer described above operates in the following manner.

Referring to FIG. 1, a stack of cutforms 3 is first placed in the feed stacker 2 with the top edge T of each cutform directed reward. Then, the stacker 2 is translationally moved upward by the pulse motor 7 until an uppermost or first cutform 3 comes into contact with the feed roller 9, whereby the cutform 3 is fed onto the transfer path 10, as indicated by an arrow B. After complete feeding of the first cutform 3, the stacker 2 is immediately lowered to suspend subsequent feeding.

The cutform 3 thus fed in is then moved forward along the transfer path 10 by the forwardly rotating transfer rollers 11–13 to a position C beyond the printing unit 14. During this forward transfer, no printing is conducted by the printing unit 14.

The position C of the cutform 3 is detected by its top edge T passing over the sensor 16. Upon such detection, the transfer rollers 11–13 are reversed in rotation to move the cutform 3 backward. During this backward movement, the printing unit 14 effects printing on the front face of the cutform 3 starting from the top edge T, as clearly illustrated in FIG. 5.

After printing the front face, the cutform 3 reaches the rearmost pair of rollers 11 and passes therethrough. When passing between the rollers 11, the top edge T of the cutform 3 must be raised slightly from the surface of the guide member 10 due to the lower one of the roller pair 11 projecting above the guide member 10. The inlet end of the return path 17 is positioned immediately before the rollers 11. Thus, the raised top edge T of the cutform 3 is brought to the inlet end of the return path 17 before bowing down and successfully introduced thereinto. Further, the downwardly bent lower edge **18*b* of the inner guide member 18 serves to guide the cutform 3 into the return path 17**.

Thus, the rearmost pair of rollers 11 provide a path shifting function in addition to a sheet transferring function. If required, the path shifting rollers 11 may be arranged so that an imaginary line connecting between their respective axes is at an angle to a plane normal to the transfer path 10. Such arrangement ensures that the top edge T of the cutform 3 is directed slightly upward upon passage between these rollers 11 to prevent any failure in entering the return path 17.

The cutform 3 thus guided into the return path 17 is then transferred to the turnover unit 21 by the return rollers 20.

Figure 4:
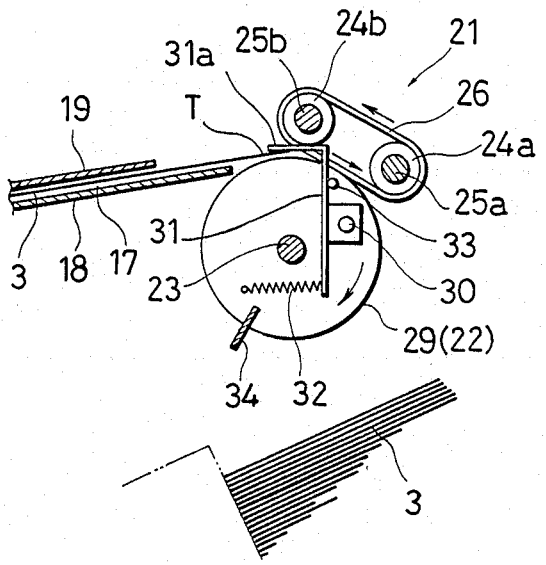
FIG. 4 is a side view in section of the turnover unit.

When the cutform 3 reaches the turnover unit 21, the top edge T of the cutform 3 is inserted between the turnover roller 22 and the endless belt 26 as well as between each disk 29 and its associated pawl **31*a*, as illustrated in FIG. 4. This condition is detected by the sensor 35 which then generates a signal to start the pulse motor 27 (FIG. 3), thereby moving the belt 26 to rotate the turnover roller 22 and the trap disk 29**.

Figure 6A:
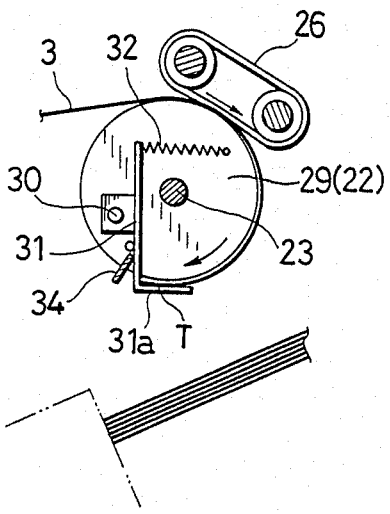
FIGS. 6*a* to 6*c* are views similar to FIG. 4 but showing successive stages of a cutform turnover operation.

With the top edge T of the cutform 3 inserted or trapped between the trap disk 29 and the lever pawl **31*a*, the cutform 3 is forcibly pulled round the turnover roller 22 and the trap disk 29 by the rotation thereof, as illustrated in FIG. 6*a*. In other words, the top edge T of the cutform 3** is moved without being influenced by the gravity at the initial stage of rotation.

Figure 6B:
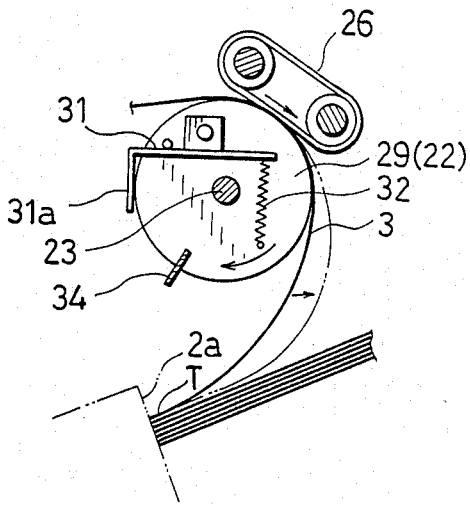
Figure 6C:
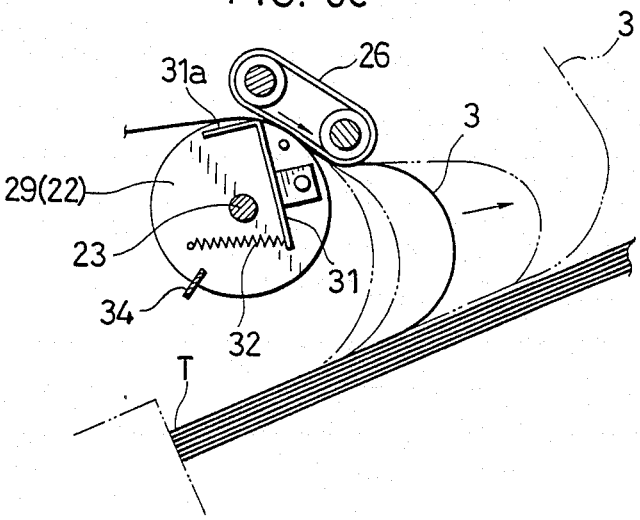

On the other hand, when the top edge T of the cutform 3 comes into abutment with the sheet stoppers 34, its further advance is restrained while the trap lever 31 or the pawl **31*a* thereof continues to rotate with the disk 29. As a result, the cutform 3 is released from the lever pawl 31*a* and gravitationally falls down onto the remaining stack of cutforms within the feed stacker 2, as shown in FIG. 6*b*. At this time, the top edge T of the cutform 3 comes into abutment with a front wall 1*a*** of the stacker.

Upon further rotation of the turnover roller 22, the cutform 3 is continuously paid out into the stacker 2 while being flexed, as illustrated in FIG. **6*c*. The cutform 3 is completely turned over when it has passed between the roller 22 and the belt 26. The cutform 3** thus turned over has its top edge T directed forward.

In case the trap disk 29 (together with the turnover roller 22) makes more than a single complete turn before completely paying out the cutform 3, the lever 31 comes in contact with the underside of the cutform 3. However, the spring 32 having a very small biasing force allows the lever 31 to be pressed downward, so that the lever 31 does not damage the cutform 3 nor hinder subsequent paying out thereof.

After complete turnover of the cutform, the trap disk 29 together with its lever 31 is brought to their initial position illustrated in FIGS. 1 to 4. Such initialization is conducted by the combination of the positioning disk 36 and the photoelectric sensor 37 which acts to stop the pulse motor 27, as described hereinbefore.

With the cutform 3 thus turned over, the feed stacker 2 is again raised to bring that particular cutform into contact with the feed roller 9 (FIG. 1). As a result, the cutform is transferred along the transfer path 10 by the forwardly rotating rollers 11–13.

Figure 7:
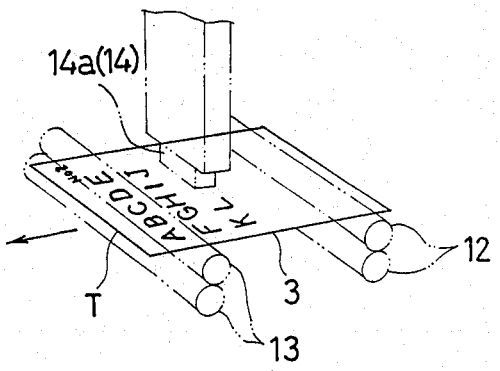
FIG. 7 is a view similar to FIG. 5 but showing a manner of printing the rear face of the cutform.

Upon reaching the printing unit 14, the top edge T of the cutform 3 is detected by the sensor 15 which actuates the printer head **14*a* to conduct printing on the reverse face of the cutform while it is moved forward, as illustrated in FIG. 7**. In this way, the reverse face printing is also conducted starting from the top edge T of the cutform, so that there occurs no deviation in printing on both faces of the cutform.

After completion of two-face printing, the cutform 3 is further transferred forward for discharge, as indicated by an arrow E in FIG. 1. The cutform may be received in a discharge stacker (not shown) in a known manner.

The above procedure is repeated to conduct printing of the cutforms remaining in the feed stacker 2.

Figure 5:
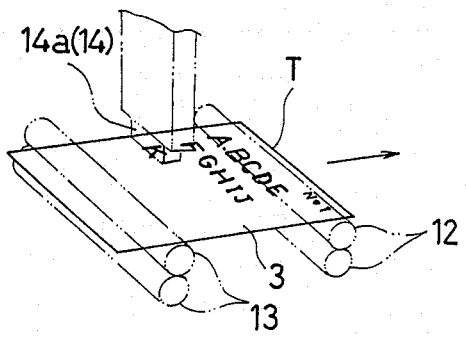
FIG. 5 is a schematic perspective view showing a manner of printing the front face of a cutform.

As appreciated by comparing FIGS. 5 and 7, the printing unit 14 is adapted to print various characters and numerals selectively in opposite orientations because the transfer direction of the cutform 3 during printing of the sheet front face differs from that during printing of the sheet rear face. Such control of the printing unit 14 is known to those skilled in the art and will not be described here.

According to the invention, the return path 17 joins the normal transfer path 10 at a position before the printing unit 14, and a part of the normal transfer path 10 is utilized as an extension of the return path 17 when the transfer rollers 11–13 are reversely rotated. This arrangement obviates a conventional return path which extends all the way around a printing unit, thereby drastically reducing the overall space and weight of the printer. For this reason, the printer according to the invention is easy to manufacture and handle, and provides a space saving arrangement.

Further, according to the invention, printing on both faces of each cutform is started from the top (same) edge thereof, so that there is no deviation in two-face printing. It should be appreciated that such a possibility is obtained by the reversibility of the transfer rollers 11–13.

According to the embodiment illustrated in FIGS. 1 to 7, the return path 17 joins the normal transfer path 10 at a position immediately before the rear most pair of transfers 11. However, the return path 17 may join the normal transfer path 10 at a position immediately before the intermediate pair of transfer rollers 12. In this case, the rear most pair of transfer rollers 11 need only to rotate in a forward direction, or may be dispensed with if the distance from the feed roller 9 to the intermediate pair of rollers 12 is short.

The return path 17 may be modified in configuration and dimensions, provided that it joins the normal transfer path 10 at a position before the printing unit 14 and extends to the turnover unit 21 which is located above the feed stacker 2.

Figure 8:
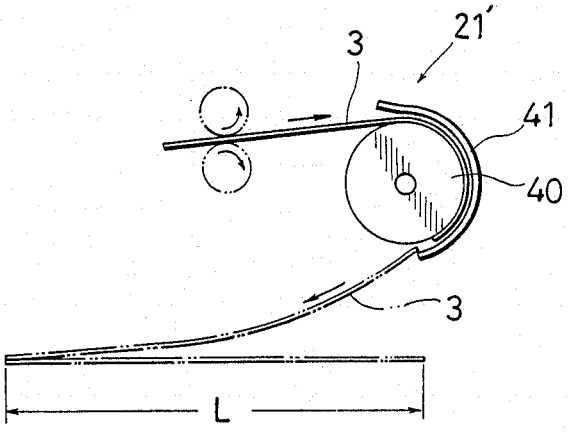
FIG. 8 is a side view of a modified turnover unit.
Figure 9:
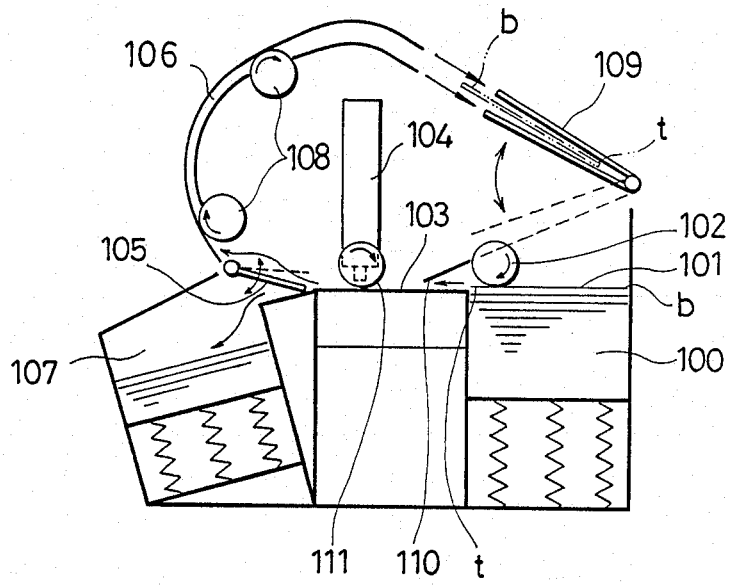
FIG. 9 is a schematic side view, in section, showing a prior art perfecting printer.
Figure 10A:
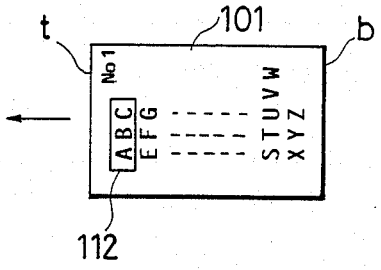
FIGS. 10*a* and 10*b* are plan views respectively showing manners of printing both faces of a cutform.
Figure 10B:
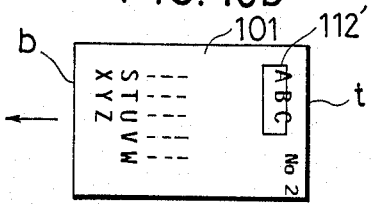

The turnover unit 21 may also be modified. FIG. 8 shows one example of such modification.

Referring to FIG. 8, a modified turnover unit 21' comprises a turnover roller 40 which is partially surrounded by a substantially arcuate guide 41 arranged as slightly spaced from the roller 40. Each cutform 3 coming out from the return path 17 (see FIG. 1) is turned over when it has completely passed through a gap between the roller and the guide 41.

As opposed to the turnover unit 21 of the foregoing embodiment in which each cutform 3 is pinched between the two moving parts 22, 26 for forcible advance, the modified turnover unit 21' utilizes a single moving part 40, so that it is necessary for the cutform 3 not to come into abutment with any object before the entire length L of the cutform 3 has passed through the gap between the roller 40 and the guide 41.

The perfecting printer according to the present invention can be used in various applications which require printing. For example, the inventive printer can be used in combination with computers or word processors.

The invention being thus described, it is obvious that the same may be modified in other various ways. For instance, the feed roller 9 may be replaced by a known vacuum-type feeder which comprises a holder for sucking up each of cutforms by vacuum and which is widely used in photocopiers. Further, the printing unit 14 may utilize various types of printer head. Such variations are not to be regarded as a departure from the spirit and scope of the invention, and all such modifications as would be obvious to those skilled in the art are intended to be included within the following claims.

We claim:

1. A perfecting printer comprising:

accommodating means for receiving a stack of cutforms;

a transfer path extending from said accommodating means;

feeding means for successively feeding the cutforms onto said transfer path;

transfer means for reversibly transferring each cutform along said transfer path;

printing means for separately printing both faces of the cutform;

a return path joining said transfer path at a position before said printing means for allowing return movement therethrough of the cutform when said transfer means is reversed;

turnover means disposed above said accommodating means and adjacent to an outlet of said return path for turning over the cutform received from said return path and for returning it again into said accommodating means, said turnover means comprising a turnover roller and a driving endless belt disposed in contact with said turnover roller for receiving therebetween the cutform and for returning it to said accommodating means as it is turned over.

2. The printer as defined in claim 1, wherein said turnover means further comprises at least one trap disk which is mounted on a shaft common to said turnover roller and substantially equal thereto in diameter, said disk is provided with a pawl positioned outside the circumference of said disk to define a gap for insertion of a leading edge of the cutform, and at least one sheet stopper is provided for releasing said leading edge of the cutform from said gap when the cutform is moved with the circumference of said turnover roller by a predetermined amount.

3. The printer as defined in claim 2, wherein said pawl is provided at one end of a trap lever which is pivotally mounted on said disk, the other end of said lever is connected to one end of a spring having its other end fixed to a suitable position of said disk to pivotally bring said lever into abutment with a stopper pin fixed to another suitable position of said disk, and said pawl is positionable inside the circumference of said disk when said lever is pivoted against the urging force of said spring.

4. The printer as defined in claim 1, wherein said transfer means comprises pairs of transfer rollers disposed before and behind said printing means, and the transfer rollers in each pair are disposed one above the other.

5. The printer as defined in claim 4, wherein said return path joins said transfer path at a position immediately before one pair of said transfer rollers which are located before said printing means.

6. The printer as defined in claim 1, wherein said return path is defined by inner and outer guide members, and said inner guide member is formed at an inlet end of said return path with a downwardly bent edge.

7. The printer as defined in claim 1, wherein said return path has a gently curved inlet portion for smooth continuity thereof with said transfer path.

8. The printer as defined in claim 1, wherein said return path is provided with at least one pair of return rollers.

9. The printer as defined in claim 1, wherein said accommodating means is in the form of a feed stacker which is movable up and down, and said feeding means comprises a feed roller which comes into frictional contact with said stack of cutforms.

10. A perfecting printing comprising:

accommodating means for receiving a stack of cutforms;

a transfer path extending from said accommodating means;

feeding means for successively feeding the cutforms onto said transfer path;

transfer means for reversibly transferring each cutform along said transfer path;

printing means for separately printing both faces of the cutform;

a return path joining said transfer path at a position before said printing means for allowing return movement therethrough of the cutform when said transfer means is reversed; and turnover means disposed above said accommodating means and adjacent to an outlet of said return path for turning over the cutform received from said return path and for returning it again into said accommodating means;

wherein said turnover means comprises a turnover roller, means for rotating said turnover roller about a rotational axis, and at least one pawl rotatable with said turnover roller about said rotational axis and defining a gap outside the circumference of said turnover roller for insertion of a leading edge of the cutform.

11. The printer as defined in claim 10, wherein said turnover means further comprises a driving endless belt disposed in contact with said turnover roller for receiving the cutform therebetween.

12. The printer as defined in claim 10, wherein said turnover means further comprises at least one trap disk which is mounted on a shaft common to said turnover roller and substantially equal thereto in diameter, said at least one pawl being positioned on said at least one disk outside the circumference thereof, and at least one sheet stopper is provided for releasing said leading edge of the cutform from said gap when the cutform is moved with the circumference of said turnover roller by a predetermined amount.

13. The printer as defined in claim 10, wherein said at least one pawl is provided at one end of a trap lever which is pivotally mounted on said disk, the other end of said lever is connected to one end of a spring having its other end fixed to a suitable position of said disk to pivotally bring said lever into abutment with a stopper pin fixed to another suitable position of said disk, and said at least one pawl is positionable inside the circumference of said disk when said lever is pivoted against the urging force of said spring.

14. The printer as defined in claim 10, wherein said transfer means comprises pairs of transfer rollers disposed before and behind said printing means, and the transfer rollers in each pair are disposed one above the other.

15. The printer as defined in claim 14, wherein said return path joins said transfer path at a position immediately before one pair of said transfer rollers which are located before said printing means.

16. The printer as defined in claim 10, wherein said return path is defined by inner and outer guide members, and said inner guide member is formed at an inlet end of said return path with a downwardly bent edge.

17. The printer as defined in claim 10, wherein said return path has a gently curved inlet portion for smooth continuity thereof with said transfer path.

18. The printer as defined in claim 10, wherein said return path is provided with at least one pair of return rollers.

19. The printer as defined in claim 10, wherein said accommodating means is in the form of a feed stacker which is movable up and down, and said feeding means comprises a feed roller which comes into frictional contact with said stack of cutforms.

* * * * *